US008827830B2

(12) United States Patent
Beaulieu

(10) Patent No.: US 8,827,830 B2
(45) **Date of Patent: *Sep. 9, 2014**

(54) CROSSCUT WEDGE GOLF CLUB

(76) Inventor: Steve Beaulieu, Warrenton, VA (US)

( * ) Notice: Subject to any disclaimer, the term of this patent is extended or adjusted under 35 U.S.C. 154(b) by 191 days.

This patent is subject to a terminal disclaimer.

(21) Appl. No.: 13/488,861

(22) Filed: Jun. 5, 2012

(65) Prior Publication Data

US 2012/0244958 A1 Sep. 27, 2012

Related U.S. Application Data

(63) Continuation-in-part of application No. 12/830,300, filed on Jul. 3, 2010, now Pat. No. 8,216,086, which is a continuation-in-part of application No. 12/273,520, filed on Nov. 18, 2008, now abandoned.

(60) Provisional application No. 61/014,816, filed on Dec. 19, 2007.

(51) Int. Cl.
*A63B 53/04* (2006.01)

(52) U.S. Cl.
CPC ..... *A63B 53/047* (2013.01); *A63B 2053/0445* (2013.01); *A63B 2053/0479* (2013.01)
USPC ..... 473/328; 473/330; 473/331; 473/349

(58) Field of Classification Search
CPC ..... A63B 53/047; A63B 2053/0479; A63B 2053/0445
USPC ..... 473/328, 330, 331, 349, 350, 344; D21/750, 751, 759
See application file for complete search history.

(56) References Cited

U.S. PATENT DOCUMENTS

| | | | | | |
|---|---|---|---|---|---|
| 3,810,631 | A | * | 5/1974 | Braly | 473/328 |
| 4,883,275 | A | * | 11/1989 | Boone | 473/334 |
| 5,029,864 | A | | 7/1991 | Keener | |
| D346,840 | S | * | 5/1994 | Fenton | D21/751 |
| 5,354,059 | A | | 10/1994 | Stuff | |
| 5,688,186 | A | | 11/1997 | Michaels et al. | |
| 5,785,610 | A | * | 7/1998 | Birmingham | 473/331 |
| 5,964,669 | A | * | 10/1999 | Bloomer | 473/250 |
| 6,048,277 | A | * | 4/2000 | Raymond | 473/331 |
| 6,309,310 | B1 | | 10/2001 | Shira | |
| 6,348,010 | B1 | | 2/2002 | Doolen | |
| 6,464,598 | B1 | * | 10/2002 | Miller | 473/314 |
| 6,471,601 | B1 | * | 10/2002 | McCabe et al. | 473/290 |
| 6,569,029 | B1 | * | 5/2003 | Hamburger | 473/238 |
| 6,605,006 | B2 | * | 8/2003 | Mason | 473/252 |
| 6,981,923 | B2 | | 1/2006 | Chappell | |
| 7,066,833 | B2 | | 6/2006 | Yamamoto | |
| 7,156,751 | B2 | | 1/2007 | Wahl et al. | |
| 7,258,627 | B2 | | 8/2007 | Chappell | |

(Continued)

*Primary Examiner* — Sebastino Passaniti
(74) *Attorney, Agent, or Firm* — Shawna J. Shaw

(57) ABSTRACT

A golf club head designed for an open face approach is provided. Several factors encountered when hitting a ball from an open face position are addressed by the disclosed club head. As a result, precision, spin rate, loft, and stopping power are significantly improved from an open face strike. The club head includes a club face having a plurality of parallel, non-intersecting grooves extending across the club face and offset at an angle to optimize backspin and minimize sidespin when a ball is struck in the toe region. The club head also provides a sole and/or trailing edge designed to accommodate an open face position and to avoid "thinned" shots.

18 Claims, 8 Drawing Sheets

(56) References Cited

U.S. PATENT DOCUMENTS

| | | | | |
|---|---|---|---|---|
| 7,758,449 | B2 * | 7/2010 | Gilbert et al. | 473/330 |
| 7,846,033 | B2 * | 12/2010 | Kato et al. | 473/242 |
| D634,804 | S * | 3/2011 | Beaulieu | D21/759 |
| 7,918,747 | B2 * | 4/2011 | Johnson et al. | 473/328 |
| 8,216,086 | B2 * | 7/2012 | Beaulieu | 473/328 |
| 2002/0183132 | A1 * | 12/2002 | Said et al. | 473/314 |
| 2005/0043113 | A1 | 2/2005 | Mann, Jr. et al. | |
| 2007/0191130 | A1 * | 8/2007 | Kouldus | 473/251 |
| 2009/0221384 | A1 * | 9/2009 | Kato et al. | 473/331 |

* cited by examiner

"Prior Art"

"Prior Art"

CROSSCUT WEDGE GOLF CLUB

This application is a Continuation-in-Part of U.S. Non-Provisional Application Ser. No. 12/830,300 filed Jul. 03, 2010, now U.S. Pat. No. 8,216,086, which is a Continuation-in-Part of U.S. Non-Provisional Application Ser. No. 12/273,520, which claims benefit to U.S. Provisional Application Ser. No. 61/014,816- all incorporated herein by reference in their entirety.

BACKGROUND OF THE DISCLOSURE

1. Field of the Disclosure

The present disclosure relates generally to golf clubs. More specifically, the present disclosure relates to a golf club head for hitting a golf ball from an open face position.

2. Background of the Disclosure

Golf clubs are used for striking a ball in the game of golf and are generally comprised of a shaft coupled to a clubhead via a hosel. The shaft also usually includes a grip for holding the golf club. Generally speaking, there are three types of clubs: woods, irons and putters. Woods are used for long distance fairway shots, irons are used for shots approaching the green, and putters are used on the green to hit the ball into the cup.

The present disclosure is directed to irons, and particularly wedges. Wedges are irons typically having a loft higher than 52° and are used for short-distance, high-altitude shots such as hitting the ball onto the green or getting the ball out of the rough. Examples of such wedges include gap, sand, and lob wedges. Loft is measured by the angle between the club's face and the vertical plane. Clubs with shorter shafts and higher lofts typically give the ball a higher and shorter trajectory. Table 1 below shows typical loft angles for different wedge types.

TABLE 1

| Wedge Type | Traditional Loft |
|---|---|
| gap | 48-54° |
| sand | 54-58° |
| lob | 58-64° |

Clubheads may take on a variety of forms, but typically comprises a face, toe, heel, crown, and sole. The United States Golf Association (USGA) provides rules and specifications for approved club designs. Such rules may be found in Appendices II and III of the "Rules of Golf" and are incorporated herein by reference in their entirety. "The Rules of Golf" is a standard reference that represents the ordinary and custom usage of golf terms. Appendix II, in particular, sets forth standard specifications and terms for golf club design as agreed upon by the golf community. Here, the "toe," "heel," "sole," "crown," and "back" are used as reference points to set forth clear specifications for approved club head dimensions.

In general, the "toe" refers to the portion of the club face farthest from the hosel or shaft, the "heel" refers to the portion of the club face closest to the hosel or shaft, and the "sole" refers to the bottom portion of the club head that typically contacts the ground. The "leading edge" of the club head is the front-most edge where the club face and the sole intersect, and "trailing edge" is the rear-most edge where the sole meets the back of the club head. "Bounce angle" refers to the angle formed between the leading edge and the portion of the sole that rests on the ground at address. Wedges typically have bounce angles somewhere between 5-12.° Higher bounce angles help to penetrate the ground under the ball in the rough or sandy areas.

During a golf stroke, the club head serves to compress the ball while grooves on the club face help to impart spin on the ball. "Backspin" is a type of spin that moves in a fast clockwise motion as viewed from a parallel standpoint to the left of the ball. It is the combination of compression and backspin that help to give the ball aerodynamic lift. Typically, more backspin equates to more control.

The grooves on the face of the club serve several purposes. As mentioned, grooves promote spin on the golf ball to help control flight. Additionally, grass can often interfere between the ball and the club face. Since grass is mostly water, the water must have someplace to go. In this regard, grooves function in a manner similar to treads on a tire—to get the water out—and thus help to maintain contact with the ball. Current USGA specifications state that: the width and cross-section of grooves must be consistent across the face of the club and along the length of the grooves; any rounding of groove edges shall be in the form of a radius which does not exceed 0.20 inches; the width must not exceed 0.035 inches; the distance between edges of adjacent grooves must not be less than three times the width of a groove, and not less than 0.075 inches; and the depth of a groove must not exceed 0.020 inches.

Normally at impact, it is desirable to have the grooves "square" to the ball, or 90° with respect to the target line. In some cases though, players may "open" the club face in an attempt to hit the ball higher (e.g., when performing short chip shots to the green). This is done by rotating the face outward such that the toe is behind the heel at impact.

Precision shots onto the green require both high spin rate and loft. Higher spin and loft help the ball to check up quickly on the green or release to the hole. Sometimes, a chip shot onto an away-ward sloping green requires the player to adjust the trajectory to a higher loft to keep the ball from rolling off the green. Higher spin rates and loft may be achieved by choosing a club with a higher number (corresponding to degree of loft)—or by opening the club face.

Opening the club face creates additional loft, but renders the horizontal grooves on conventional clubs far less effective for stopping the ball on the green. This is because the grooves are no longer square to the target line when the face is open. In other words, the grooves are not optimally aligned for imparting maximum backspin on the ball. As a result, higher spin rates and better control are difficult to achieve when opening the club face with conventional clubs. Figuratively, this can be translated that conventional clubs have no "brakes" for stopping a ball on the green with an open face approach.

Other drawbacks to opening the club face of conventional clubs include causing the bounce angle to become too high. In this case, the leading edge is raised to the point where it may interfere with the ball. Thus, high bounce angles are the primary cause of "thinned" shots—where the ball is struck along the leading edge. Another drawback is that glare may be increased—reducing player visibility and striking accuracy. Still another drawback to opening the club face of conventional clubs is that "feel" and control of the club may be adversely affected.

In addition to the above drawbacks, many prior art wedges comprise a horizontal curvature across the clubface. This "bulging" clubface configuration is generally designed to correct for slices or hooks. Such clubs rely on the "gear effect" that induces a counteractive sidespin on the ball when hit in the toe or heel (respectively)—to draw it back toward the center. It is further appreciated in the art that the "gear effect" is intended for a normal address. In other words, the "gear effect" is ineffective for an open clubface—adversely affecting the amount of corrective sidespin induced (i.e., too much/too little "draw" back toward the center).

There is therefore a need for a golf club head that imparts optimal backspin on a ball when struck with the club face open. A need also exists for a golf club head that provides more control and stopping power when hitting a ball with an open address. There is further a need for a sole or trailing edge that accommodates the open position and allows the loft to be effectively increased while avoiding thinned shots traditionally associated with high bounce angles. Moreover, there is a need for a longer hosel or shaft that provides improved feel and control in the open face position. The present disclosure addresses these needs and others.

SUMMARY OF THE DISCLOSURE

The present disclosure overcomes drawbacks of the prior art in part by providing "crosscut" grooves offset at an angle across the face of a club head. Such grooves are aligned to be square with the ball and/or target line in the open position and to maximize backspin on a ball when struck with the club face open. By maximizing backspin from an open face approach, golfers are able to "get the ball up" in a controlled manner and with greater stopping power. The present disclosure additionally overcomes drawbacks of the prior art in part by providing grooves on the club face that extend into the toe, thereby increasing effective club height and usable impact area in the open position. The present disclosure further overcomes drawbacks of the prior art in part by providing a sole that accommodates an open face position and allows loft angle to be increased while avoiding thinned shots. The present disclosure further overcomes drawbacks of the prior art in part by providing a flat club face, and a long hosel and/or shaft for improved "feel" and control.

According to one aspect, the disclosure provides a golf club head for use with a shaft and providing significantly improved backspin from an open face position. The club head comprises: a hosel coupling the club head to a shaft; a substantially flat club face having: a toe region; a heel region; and backspin inducing means extending across the club face and across the toe, the backspin inducing means maximizing backspin and minimizing sidespin when a ball is struck in the toe region. The club head additionally includes: a sole defining a lower region of the club head, the sole having: a leading edge intersecting the base of the club face; a trailing edge intersecting a back portion of the club head opposite the club face; and open face accommodating means for readily facilitating an open address and where the leading edge does not interfere with striking the ball.

According to another aspect, the disclosure provides a golf club head for use with a shaft and providing significantly improved backspin from an open face position. The club head comprises: a hosel for coupling the club head to a shaft; a substantially flat club face having: a toe region; a heel region; and a plurality of parallel, non-intersecting grooves extending across the club face and across the toe, the grooves aligned at an offset angle with respect to the base of the club face in the direction of the hosel, the grooves further maximizing backspin and minimizing sidespin when a ball is struck in the toe region from an open face position. The club head further includes: a sole defining a lower region of the club head, the sole having a leading edge intersecting the base of the club face and a trailing edge intersecting a back portion of the club head opposite the club face; at least a portion of the sole configured to readily accommodate an open-face position and where the leading edge does not interfere with striking the ball.

According to yet another aspect, the disclosure provides a golf club providing significantly improved backspin from an open face position. The golf club comprising: a shaft with a handle at a proximal end; and a club head with a hosel coupling the club head to a distal end of the shaft; the club head further including: a substantially flat club face having: a toe region; a heel region; and backspin inducing means extending across the club face and across the toe, the backspin inducing means maximizing backspin and minimizing sidespin when a ball is struck in the toe region. The club head further including: a sole defining a lower region of the club head, the sole having: a leading edge intersecting the base of the club face; a trailing edge intersecting a back portion of the club head opposite the club face; and open face accommodating means for readily facilitating an open address and where the leading edge does not interfere with striking the ball.

One of several advantages of the disclosed club head is its ability to impart significantly improved backspin as well as a substantially straight trajectory on a ball when struck with the club face open. For example, by offsetting the grooves to be "square" with the ball in the open face position, backspin is significantly increased. Further, by improving the amount of backspin from an open approach, better precision shots onto the green may be achieved.

Another advantage provided by the device, is that it improves performance for higher handicappers who tend to hit the ball in the toe portion when opening the club face. In addition to helping golfers "get the ball up," backspin is significantly improved and "thinned" shots are avoided. As a result, higher handicappers are able to stop the ball much more quickly on the green.

The golf club head of the present disclosure is designed to improve both control and stopping power from an open-face approach. The disclosed club head addresses the increased likelihood of striking the ball in the toe region when opening the club face. The club head also provides grooves offset to stay substantially "square" with the ball and the target line from the open face position. Additionally, the club head avoids unpredictable sidespin by providing a substantially flat clubface. Moreover, by providing a sole that readily accommodates an open face, the effective loft may be increased while avoiding "thinning" associated with higher bounce angles. Thus, as a result of the disclosed club head, a synergistic effect of "getting under the ball" from an open approach (corresponding to a higher trajectory)—and maximized backspin (corresponding to significantly improved stopping power)—is achieved.

The disclosed club may be manufactured using a variety of techniques. For example, the club head may be forged, cast, die-stamped, machined, hand-cut, or the like. Materials for the shaft and/or club head may include, but are not limited to, soft carbon steel, stainless steel, and titanium. In embodiments, the club head and/or shaft is composed of 1018 soft carbon steel that provides the golfer with more "feel" because it is softer than stainless steel.

Preferably, the groove configurations and dimensions conform to USGA specifications and standards. It is appreciated that grooves having any approved configuration may be used including square, V-shaped, U-shaped, etc. It is further appreciated that any USGA-approved dimensions (width, depth, length, spacing, etc.) may be used.

DETAILED DESCRIPTION OF VARIOUS EMBODIMENTS OF THE DISCLOSURE

Reference will now be made in detail to various exemplary embodiments of the disclosure, examples of which are illustrated in the accompanying drawings. It is understood that that drawings are not necessarily to scale, but are representative of the features of the present disclosure. The following detailed description describes certain embodiments of the disclosure, and should not be considered as limiting the disclosure to those embodiments.

The present disclosure addresses problems associated with attempting precision shots on the green with an open club face. According to embodiments, the present disclosure provides a plurality of grooves offset at an angle across the club face. The grooves are offset at an angle to maximize backspin on the ball from an open approach while minimizing undesired sidespin. According to embodiments, the offset grooves continue substantially to the outside edges of the club face to increase the amount of usable impact area in the open position. According to still further embodiments, a substantially flat club face is provided to avoid unpredictable/excessive sidespin from an open face position. According to yet further embodiments, a sole configured to accommodate an open face position and to avoid "thinned" shots is provided.

The present disclosure significantly improves backspin from an open face position while enabling a substantially straight trajectory. As a result, better precision shots having a higher spin rate and loft may be achieved. The disclosed golf club also helps higher handicappers, for example, to "get the ball up" (from deep lies, hard pan, sand, etc.) and provides significantly improved stopping power for landing the ball on the green.

Figure 1:
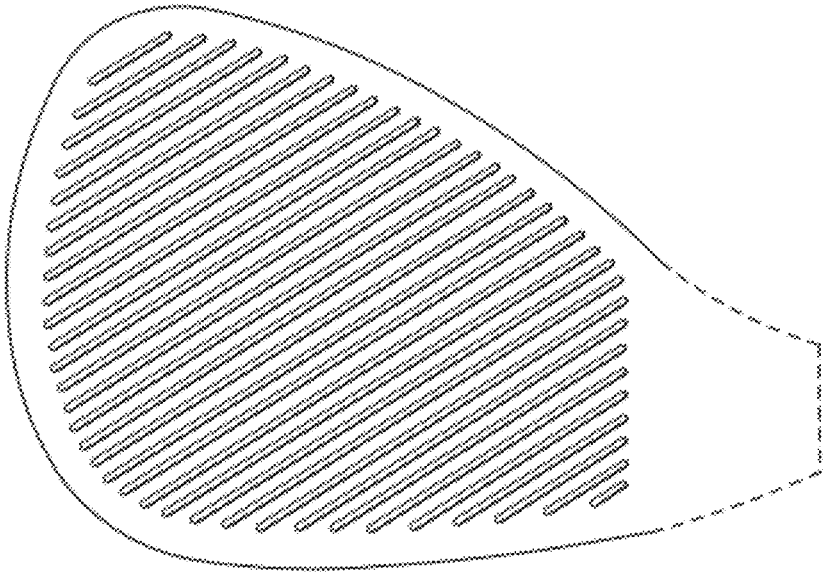
FIG. 1 shows a front view of a club face according to one embodiment of the present disclosure.

Turning now to the figures, which depict various exemplary embodiments of the disclosure, FIG. 1 shows a front view of a club face 14 according to the principles of the disclosure. The club face 14 includes a toe 16 and a heel 18. In this particular embodiment, a plurality of grooves 20, are aligned at about a 30° offset with respect to the base of the club face 14. In other embodiments, the grooves are aligned at an offset angle between 15-30°. As a result, the offset grooves 20 are aligned with the ball when the club face is opened to achieve a substantially straight trajectory and to induce improved backspin. Consequently, the offset grooves 20 provide enhanced spin, control and stopping power on a ball when hit with the club face 14 open. Preferably, the disclosed grooves are designed to conform to USGA standards and specifications. Accordingly, grooves having any USGA-approved configuration or dimensions (e.g., length, width, depth, spacing, etc.) may be used. In addition, the grooves may be square, V-shaped, U-shaped, etc.

Preferably, the golf club is a wedge having a 52-64° loft angle. However it is appreciated that enhanced spin, control and stopping power may be achieved by opening the face of any wedge with any associated loft angle. In some cases, opening the club face 14 may serve to effectively increase the loft of the club to be greater than 64°. Such loft angles may be desirable for improving precision shots and helping higher handicappers to "get the ball up."

It is possible that the grooves 20 may extend substantially to the edge, or outer portion, of the club face 14. By extending the grooves substantially to the edge of the club face, more water may be eliminated from the face surface and/or the amount of usable impact area optimized.

Figure 2:
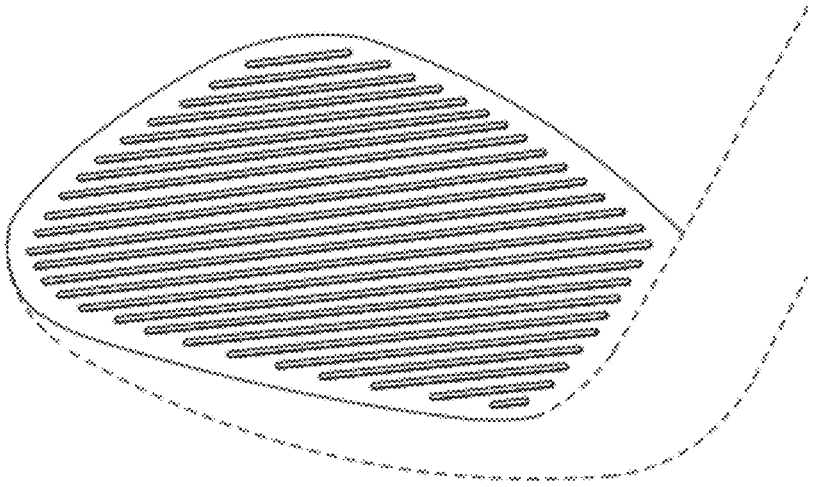
FIG. 2 shows front view of a club face according to another embodiment of the present disclosure.

FIG. 2 shows a front view of a club face 14 according to another embodiment. Again, the club face 14 includes a toe 16 and a heel 18. In this particular embodiment, grooves 20 are aligned at about a 22° offset with respect to the base of the club face 14. As a result, the offset grooves 20 are aligned with the ball when the club face is opened to achieve a substantially straight trajectory and improved backspin. Consequently, the offset grooves 20 provide enhanced spin, control and stopping power on a ball when hit with the club face 14 open.

It is possible that the grooves 20 may extend substantially to the edge, or outer portion, of the club face 14. By extending the grooves substantially to the edge of the club face, more water may be eliminated from the face surface and/or the amount of usable impact area optimized.

Figure 3:
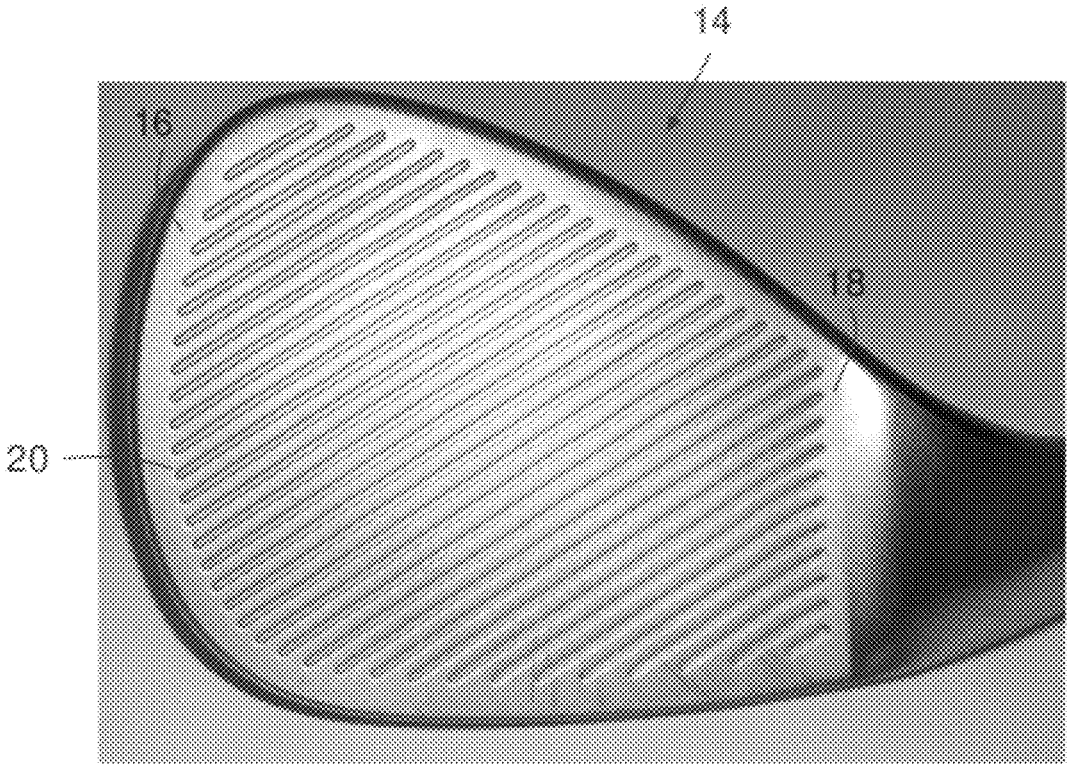
FIG. 3 shows a photograph of a club face according to the principles of the present disclosure.

FIG. 3 shows a golf club face 14 manufactured according to the inventive concepts of the present disclosure. Again, the club face 14 includes a toe 16 and heel 18. As shown, the grooves 20 are offset at an angle and extend substantially across the club face 14 including the toe 16. As depicted in the figure, the outer edges of the club face 14 are smoothed e.g., for aesthetic, safety, or other reasons. For example, if the club head is manufactured from forged soft carbon steel, the edges may be ground to obtain a smoother edge. In embodiments, the grooves 20 may be die-stamped or milled (either by hand or machine) into the club face 14, or an equivalent technique used.

Figure 4:
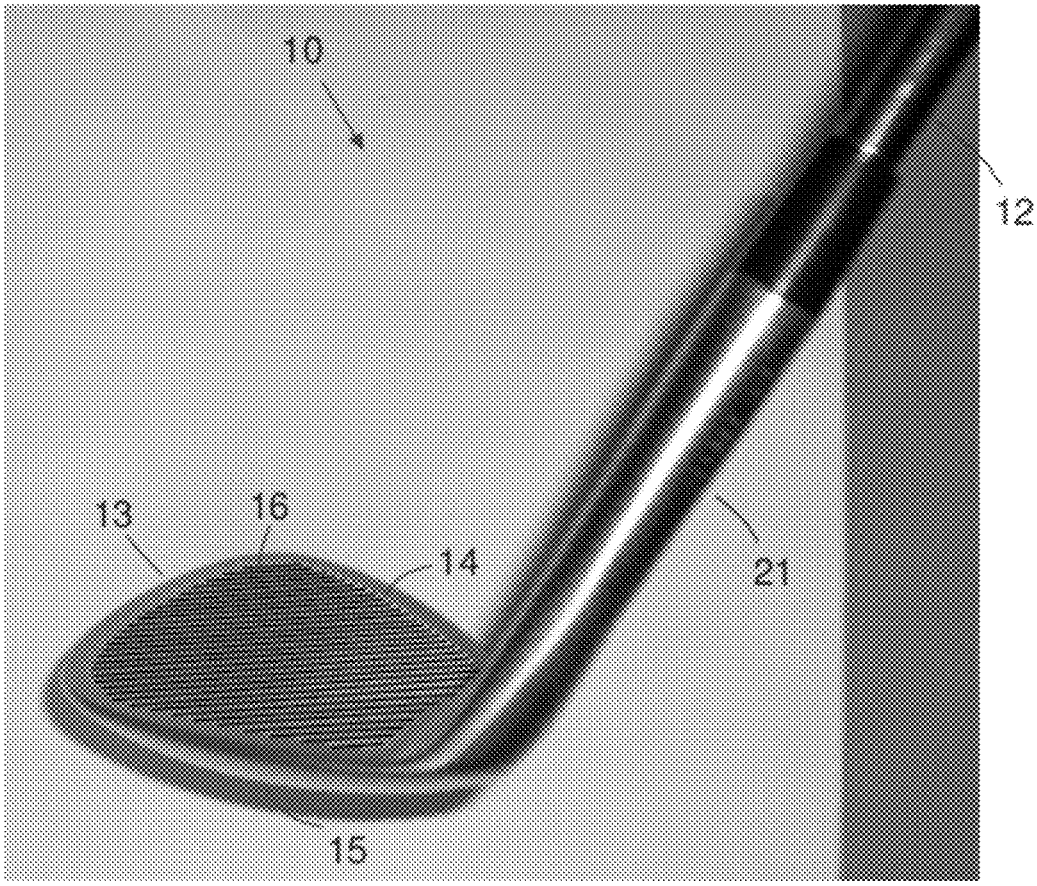
FIG. 4 shows an isometric view of a golf club according to an embodiment of the present disclosure.

FIG. 4 shows an isometric view of a golf club 10 according to the principles of the present disclosure. As shown, the golf club 10 includes a club head 13 coupled to a shaft 12 via a hosel 21. The club head 13 includes a sole 15 and a face 14 having a groove configuration as discussed with respect to FIGS. 1-3. Preferably, the golf club 10 is a wedge-type club with a loft angle between 52-64°. It is appreciated that the shaft 12 may comprise any conventional shaft, and in embodiments may include a True-Temper™ parallel shaft. In addition, it is understood that the shaft 12 may also include a grip (not shown) as will be appreciated by those skilled in the art.

Figure 5A:
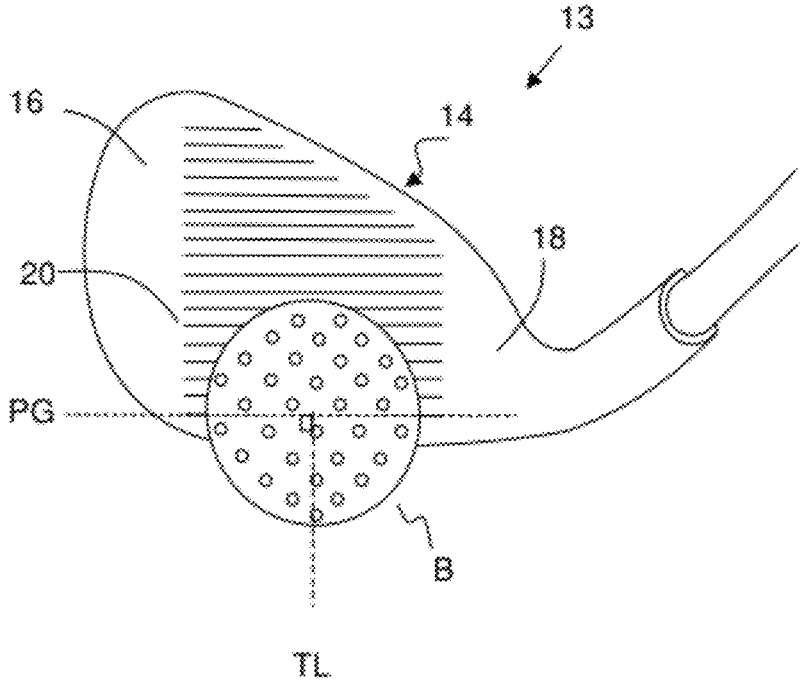
FIG. 5*a* depicts a prior art wedge with a front address.

FIG. 5*a* depicts a front view of a prior art club head 13 with a normal address. The club face 14 includes a toe 16, heel 18, and a plurality of grooves 20. As can be seen in FIG. 5*a*, the horizontal grooves 20 are parallel to the ground (as indicated by line PG) and are "square" to the ball B and intended target line TL.

Figure 5B:
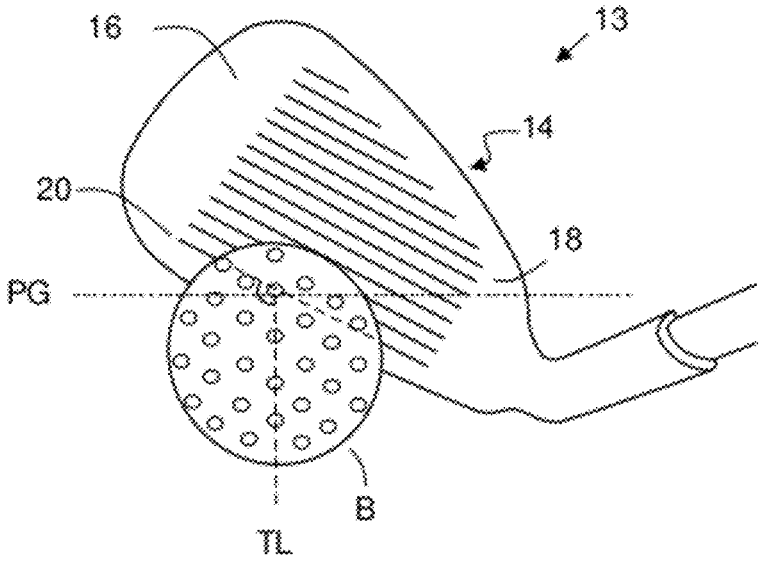
FIG. 5*b* depicts a prior art wedge with an open address.

FIG. 5*b* depicts a prior art club approaching a ball B from an "open" address. Here, the horizontal grooves are no longer parallel to the ground (as indicated by line PG), and are no longer square to the ball B or intended target line TL. Moreover, it can be seen how the ball may be more readily struck by the smooth toe.

Figure 5C:
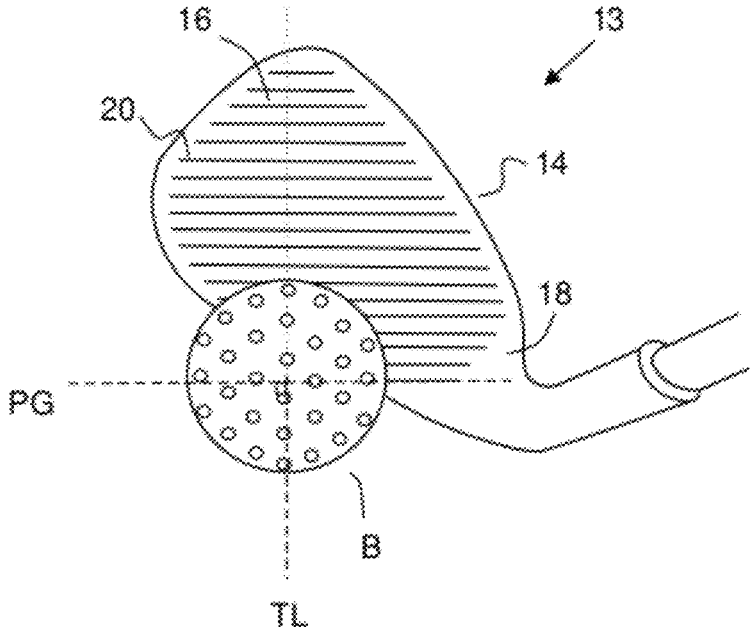
FIG. 5*c* depicts a front view of a club according to the principles of the present disclosure with an open address.

FIG. 5*c* depicts a club head 13 approaching a ball from an open address according to principles of the present disclosure. Again, the club face 14 includes a toe 16, heel 18, and a plurality of grooves 20. The grooves are offset about 25° in the direction of the shaft. It can be seen here that the grooves 20 are substantially normal with the ball B and the target line TL with an open address. In addition, the grooves extend into the toe 16 to increase backspin on the ball B when struck in this region from an open approach.

Figure 5D:
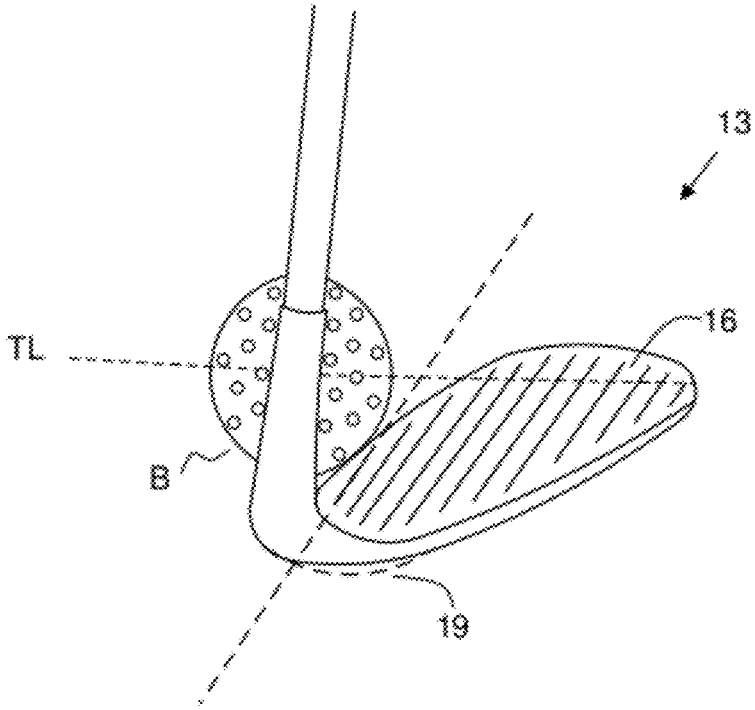
FIG. 5*d* depicts an isometric view of a club according to the principles of the present disclosure with an open address.

FIG. 5*d* depicts an isometric view of a club head 13 approaching a ball B from an open position according to the principles of the present disclosure. This particular figure shows where the trailing edge 19 is ground to lie flat or parallel with the ground in an open position. However, it is appreciated that in some cases the trailing edge 19 may be ground such that a slight amount of curvature remains. Because opening the club face 14 effectively increases the bounce angle, the trailing edge 19 is ground such that the leading edge 17 is not raised too high so as to interfere with a shot. In some embodiments, the trailing edge 19 is ground near the heel region to better accommodate an open position. In some embodiments, the trailing edge 19 is ground such that the leading edge 17 is substantially flush with the ground.

Figure 6A:
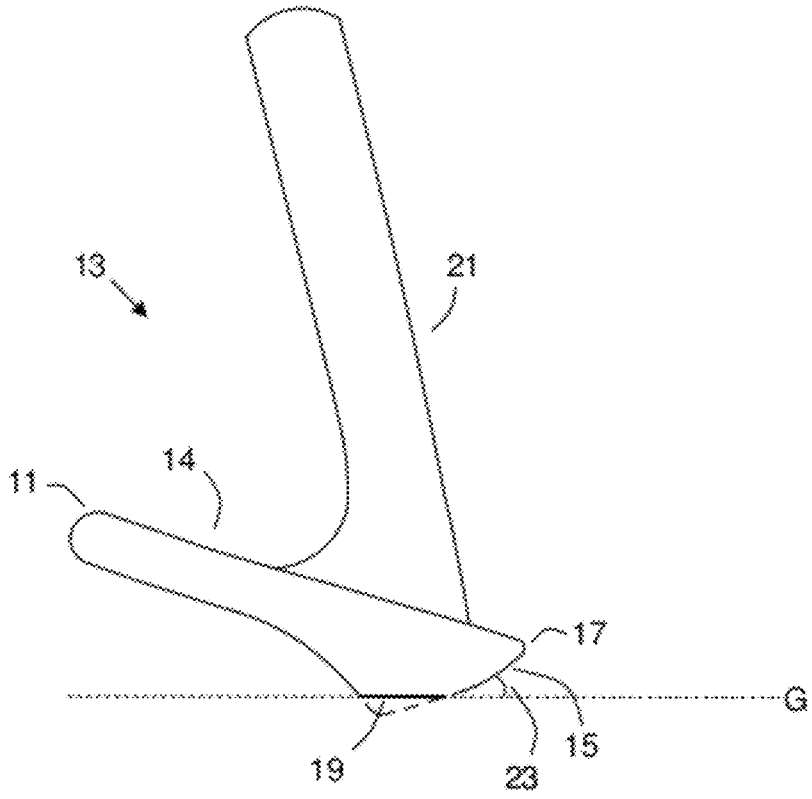
FIG. 6*a* depicts a side view of a club according to another embodiment of the disclosure.
Figure 6B:
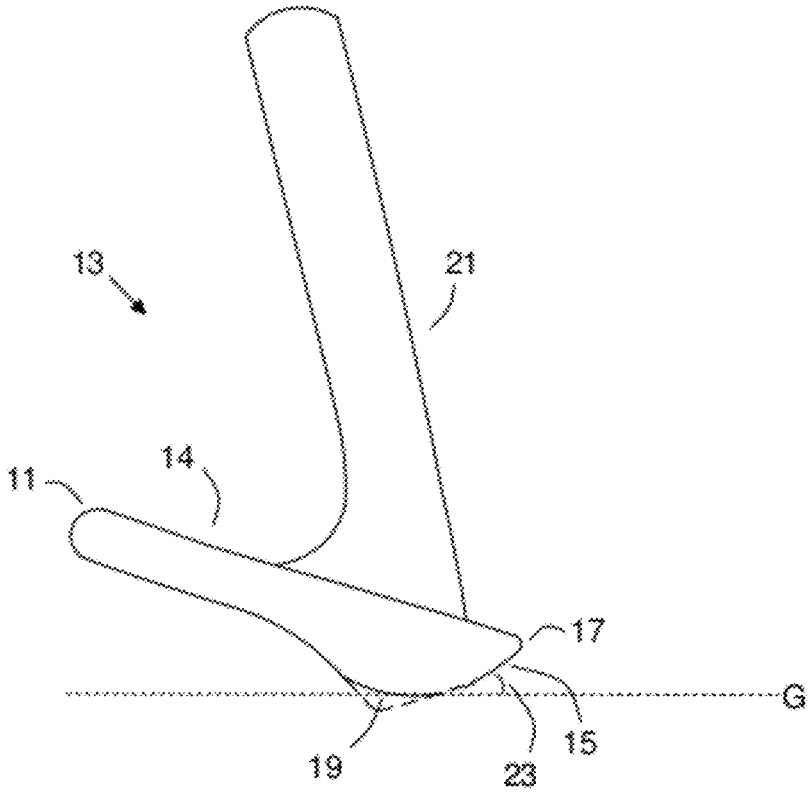
FIG. 6*b* depicts a side view of a club according to yet another embodiment of the disclosure.

FIG. 6*a* depicts a side view of a club head 13 according to principles of the present disclosure. Again, the club head 13 comprises a club face 14, crown 11, sole 15, leading edge 17, trailing edge 19, and hosel 21. In this case, the trailing edge 19 of sole 15 is ground down so that a portion of the trailing edge 19 is substantially flat or parallel with the ground from an open address. The resulting trailing edge and/or sole portion readily accommodates an open face position. Furthermore, since opening the face of conventional clubs causes the leading edge to be raised, the disclosed trailing edge 19 is ground to keep the leading edge 17 from being raised too high and interfering with the ball. FIG. 6*b* shows similar elements as FIG. 6*a*, however the trailing edge is ground down such that a slight amount of curvature remains.

The golf club 10 of the present disclosure may be manufactured using a variety of conventional processes and/or techniques. In embodiments, the club head 13 may be forged, cast, die-stamped, machined, hand-cut, or the like. It is also appreciated that the club head 13 may be comprised of soft carbon steel, stainless steel, titanium, etc. In preferred embodiments, the club head 13 is composed of 1018 soft carbon steel that provides the golfer with more "feel" because it is softer than stainless steel.

The club head 13 may further have a dark-black oxide, gunmetal finish, or the like to reduce glare when the club face is open. Because an increased viewable surface is created when the club face is open, glare often becomes an interfering factor. By specifically providing a low-glare finish on the club head, a golfer's view of the open club face is improved.

As mentioned, the edges of the club face 14 may be ground or smoothed e.g., for aesthetic, safety and/or other purposes. In addition, by grinding down the trailing edge 19 of the sole 15 as disclosed, the toe of the club head 13 may be more controllably tilted back to an open face position. According to various embodiments, the trailing edge of the sole is ground, molded, etc. to accommodate an open position such that the toe may be rotated back around 5-20°. To achieve this, it is appreciated that the trailing may be ground to be flat, or slightly curved.

In further embodiments, an extra long shaft 12 and/or hosel 21 effectively provides a higher center of gravity and thus better feel and control in the open face position. It is appreciated that the shaft 12 may comprise any conventional shaft, and in embodiments may include a True-Temper™ parallel shaft. In addition, it is understood that the shaft 12 may also include a grip (not shown) as will be appreciated by those skilled in the art. Another purpose of a longer shaft 12 or hosel 21 is to add weight to the club. In some cases, this may serve to compensate for weight taken away e.g., from grinding the trailing edge 19.

It can thus be seen that the present disclosure provides solutions for performing precision shots on the green with the club face open. The present disclosure provides a plurality of grooves offset at an angle for maximizing backspin with an open face approach—greatly increasing its stopping ability on the green.

The foregoing disclosure of the preferred embodiments of the present disclosure has been presented for purposes of illustration and description. It is not intended to be exhaustive or to limit the disclosure to the precise forms disclosed. For example, it is contemplated that the grooves may be provided on an insert or face so as to be removable or interchangeable. Many variations and modifications of the embodiments described herein will be apparent to one of ordinary skill in the art in light of the above disclosure.

The invention claimed is:

1. A golf club head for use with a shaft and providing improved backspin from an open face position, the club head comprising:

a) a hosel coupling the club head to a shaft;

b) a flat club face having:

a toe region;

a heel region; and backspin inducing means for increasing induced backspin from the open face position, the backspin inducing means extending across the club face and across the toe region;

c) a sole defining a lower region of the club head, the sole having:

a leading edge intersecting the base of the club face;

a trailing edge intersecting a back portion of the club head opposite the club face; and open face accommodating means for readily facilitating an open address and for reducing the likelihood that the leading edge will interfere with the ball when struck with the club face open.

2. The golf club head of claim 1, where the backspin inducing means also increases induced backspin when a ball is struck in the toe region.

3. The golf club head of claim 1, where the backspin inducing means further reduces induced sidespin when the ball is struck in the toe region.

4. The golf club head of claim 1, where the open face accommodating means corresponds to at least a portion of the trailing edge.

5. The golf club head of claim 1, where the open face accommodating means corresponds to at least a portion of the sole in the heel region.

6. The golf club head of claim 1, where the open face accommodating means enables the leading edge to be almost flush with the ground in an open face position.

7. A golf club head for use with a shaft and providing improved backspin from an open face position, the club head comprising:

a) a hosel coupling the club head to a shaft;

b) a flat club face having:

a toe region;

a heel region; and a plurality of parallel, non-intersecting grooves extending across the club face and across the toe region, the grooves aligned at an offset angle with respect to the base of the club face in the direction of the hosel, the grooves further increasing backspin when a ball is struck in the open face position; and c) a sole defining a lower region of the club head, the sole having a leading edge intersecting the base of the club face and a trailing edge intersecting a back portion of the club head opposite the club face; at least a portion of the sole accommodating an open-face address and reducing the likelihood that the leading edge will interfere with the ball when struck with the club face open.

8. The golf club head of claim 7, wherein the grooves induce increased backspin when a ball is struck in the toe region.

9. The golf club head of claim 7, wherein the grooves induce reduced sidespin when the ball is struck in the toe region.

10. The golf club head of claim 7, where at least a portion of the trailing edge is configured to accommodate an open face position.

11. The golf club head of claim 7, where at least a portion of the sole in the heel region is configured to accommodate an open face position.

12. The golf club head of claim 7, where at least a portion of the sole and/or trailing edge enables the leading edge to be almost flush with the ground in an open face position.

13. A golf club for providing improved backspin from an open face position, the club comprising:

a) a shaft with a handle at a proximal end; and b) a club head with a hosel coupling the club head to a distal end of the shaft;

the club head further including:

a flat club face having:

a toe region;

a heel region; and backspin inducing means for increasing induced backspin from the open face position, the backspin inducing means extending across the club face and across the toe region; and a sole defining a lower region of the club head, the sole having:

a leading edge intersecting the base of the club face;

a trailing edge intersecting a back portion of the club head opposite the club face; and open face accommodating means for readily facilitating an open address and for reducing the likelihood that the leading edge will interfere with the ball when struck with the club face open.

14. The golf club of claim 13, where the backspin inducing means also increases induced backspin when a ball is struck in the toe region.

15. The golf club of claim 13, where the backspin inducing means further minimizes sidespin when the ball is struck in the toe region.

16. The golf club of claim 13, where the open face accommodating means corresponds to at least a portion of the trailing edge.

17. The golf club head of claim 13, where the open face accommodating means corresponds to at least a portion of the sole near the heel region.

18. The golf club of claim 13, where the open face accommodating means enables the leading edge to be almost flush with the ground in an open face position.

* * * * *